US006024222A

United States Patent [19]

Friberg et al.

[11] Patent Number: 6,024,222

[45] Date of Patent: Feb. 15, 2000

[54] BLISTER PACK

[75] Inventors: Claes Friberg, Haninge; Christian Assargren, Bromma, both of Sweden

[73] Assignee: Astra Aktiebolag, Sodertalje, Sweden

[21] Appl. No.: 08/930,778

[22] PCT Filed: Jun. 24, 1997

[86] PCT No.: PCT/SE97/01130

§ 371 Date: Oct. 8, 1997

§ 102(e) Date: Oct. 8, 1997

[87] PCT Pub. No.: WO98/00351

PCT Pub. Date: Jan. 8, 1998

[30] Foreign Application Priority Data

Jul. 1, 1996 [SE] Sweden ..... 9602605

[51] Int. Cl.[7] ..... B65D 83/04

[52] U.S. Cl. ..... 206/531; 206/534; 206/539; 206/469

[58] Field of Search ..... 206/531, 534, 206/539, 534.1, 828, 467, 469

[56] References Cited

U.S. PATENT DOCUMENTS

| | | | |
|---|---|---|---|
| 2,780,353 | 2/1957 | Volckening | 206/531 |
| 3,743,084 | 7/1973 | Douglas . | |
| 3,921,804 | 11/1975 | Tester | 206/534.1 |
| 4,125,190 | 11/1978 | Davie, Jr. et al. | 206/532 |
| 4,340,141 | 7/1982 | Fischer . | |
| 4,974,729 | 12/1990 | Steinnagel . | |
| 5,323,907 | 6/1994 | Kalvelage | 206/531 |

FOREIGN PATENT DOCUMENTS

| | | |
|---|---|---|
| 4429503 | 8/1994 | Germany . |
| 2224720 | 11/1989 | United Kingdom . |
| 2250978 | 12/1990 | United Kingdom . |
| 2266880 | 5/1992 | United Kingdom . |

*Primary Examiner*—Paul T. Sawell
*Assistant Examiner*—Nhan T. Lam
*Attorney, Agent, or Firm*—White & Case LLP

[57] ABSTRACT

A blister pack comprises a blister assembly (10) including two blister parts (11,12) which are interconnected and foldable towards each other, each blister part (11, 12) having a set of blisters (16). The blisters (16) of one blister part (11) are so offset relative to the blisters (16) of the other blister part (12) that, after folding, the blisters (16) of the two blister parts (11, 12) engage between each other. The blister pack further comprises a protective unit (20) including two closure panels (21, 22) and preferably one intermediate panel (23), which is defined by two folding lines (24, 25). The blister pack also comprises a supporting unit (30) including at least one base panel (31), which has at least one hole (33). The supporting unit (30) is connected to said blister assembly (10) such that the blisters (16) of at least one blister part (11) are aligned with said at least one hole (33). The protective unit (20) includes a tab (26; 26'), which is connected to one closure panel (21) via at least one folding line (27; 27'). The supporting unit (30) is fixedly joined to said tab (26; 26') such that the closure panels (21, 22) cover said lid foils after folding of the blister assembly (10) and the protective unit (20).

19 Claims, 3 Drawing Sheets

BLISTER PACK

Figure 1A:
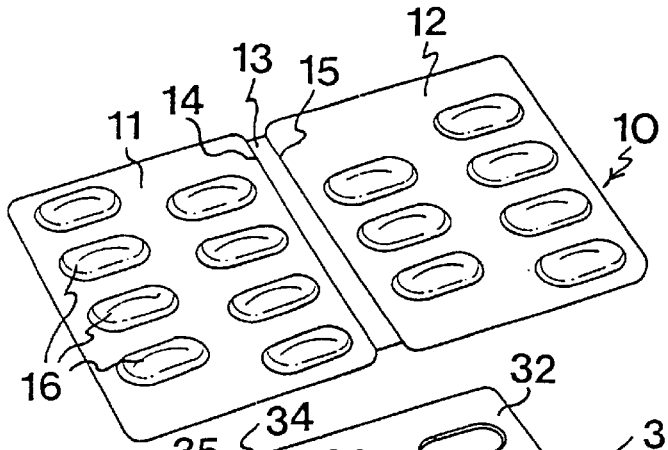
Figure 1B:
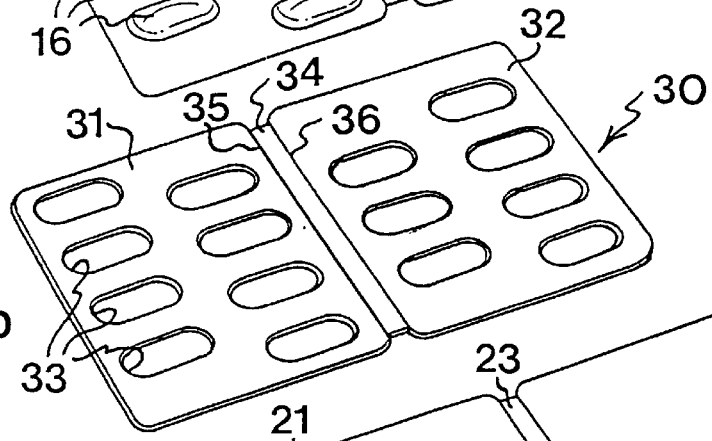
Figure 1C:
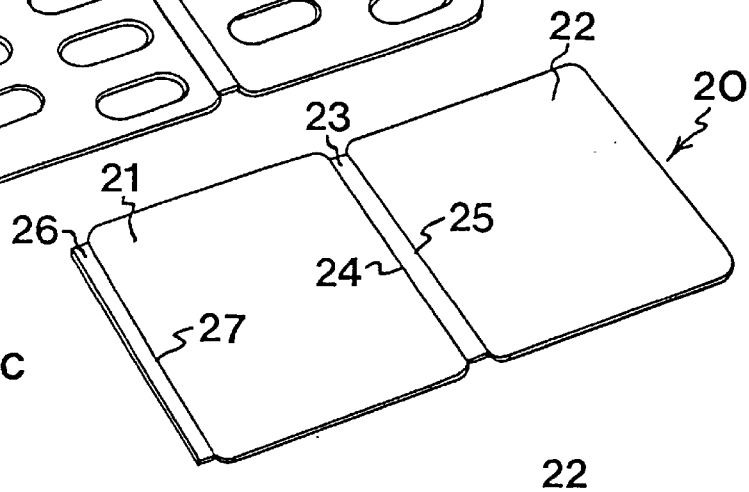
Figure 1D:
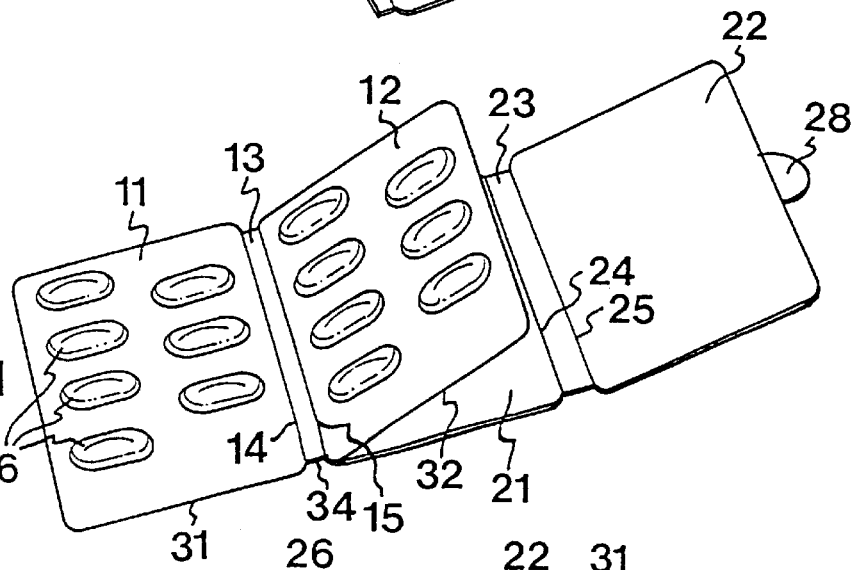
Figure 1E:
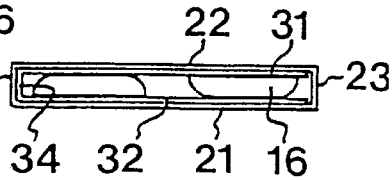

The present invention relates to a foldable blister pack, especially for drugs, an apparatus and a method for manufacturing such a blister pack, as well as the use of the same.

Blister packs for drugs in tablet form or in the form of powder or liquid enclosed in a capsule normally incorporate at least one blister part, which consists of a set of interconnected foils covering each other. One relatively rigid foil is in most cases referred to as the base and comprises cavities, so-called open "blisters", for accommodating a tablet or capsule each, while the other foil, which is flat, is in most cases referred to as the lid and seals the opening of the cavities or blisters.

Examples of suitable materials for the lid are hard aluminium, soft aluminium, paper, polyester, polypropylene and PVC, and examples of suitable materials for the base are aluminium laminate, polypropylene, PVC, PVC/Aclar and PVC/PVDC. There also exist various laminates that may be used as basic material for these foils.

Blister packs can be accidentally damaged when they are being carried around in pockets, handbags etc. Such damage occurs frequently, especially if the lid foil is breakable. As a rule, blister packs are therefore stacked in a separate box or casing, which protects the blisters during transport. This package is normally bulky and voluminous owing to the construction of the blister packs. Further, the user might unintentionally lose the casing, or even throw it away. Thus, the presence of a casing does not in practical use guarantee that the drug is adequately protected.

To remedy this inconvenience, German Patent Application 44 29 503 discloses a compact blister pack comprising a foldable blister assembly. The blister assembly consists of two blister parts, each having a set of blisters, and an intermediate part free of blisters, which is located between the blister parts and is defined by two folding lines. The blister parts are foldable towards each other along said folding lines. The blisters of one blister part are so offset relative to the blisters of the other blister part that, after folding, the blisters of the two blister parts engage between each other. To protect the lid foil of the folded blister assembly, there is provided a protective unit which includes two closure panels that are interconnected by means of an intermediate panel, which is defined by two folding lines. This intermediate panel is joined to the intermediate part of the blister assembly such that a foldable blister pack is formed, in which the closure panels cover the lid foils after folding the blister pack.

One disadvantage of this compact blister pack is that the user has little space available for handling the blisters, in particular the blisters in the row adjacent to the intermediate part. A drug is removed by the user pressing one of the blisters with one of his fingers, thereby breaking the lid foil. Due to the lack of space, there is a risk that a blister part is torn away from the intermediate part, which is fixed to the protective casing. In such event, the blister part is no longer protected by the casing and is also separated from the user instructions that are printed on or attached to the protective casing.

Also, when a drug is being removed from the known blister pack, the blister parts have a tendency to bend and become dented. After some use, it might therefore be difficult, or even impossible, to fold the blister pack, since the uneven and dented blister parts no longer fit together.

Further, frequent use of the known blister pack might also lead to unintentional separation of a blister part from the casing, since the folding lines of the blister assembly are weakened each time the pack is folded or unfolded. This problem is more pronounced when the blister assembly is made of thin and/or flexible material.

Moreover, it is difficult to combine different drugs in the known blister pack. This blister pack requires the use of a foldable blister assembly, which is formed in one piece. Thus, in order to combine different drugs, these drugs must be combined when manufacturing the blister assembly. If different sets of drugs are to be used in the known blister pack, it is therefore necessary to keep a variety of blister assemblies in stock, each bliter assembly containing a specific combination of drugs.

The prior art also comprises GB-B-1 133 947, GB-A-2 266 880, U.S. Pat. No. 3,743,084 and U.S. Pat. No. 4,340 141, disclosing other types of foldable packages containing blister parts.

The object of the invention is to solve or alleviate at least some of the problems described above. More specifically, the blister pack according to the invention should be compact and obviate the need for a separate, protective casing. Further, the blister pack should be durable and minimise the risk of the blister pack being accidentally damaged during use. Also, the blister pack should be capable of permanently carrying instructions for use, and preferably facilitate the provision of different drug combinations. Preferably, the blister pack should also provide for simple recycling of the materials used.

This object is achieved by the blister pack according to the appended claims.

The blister pack according to the invention has the advantage that the supporting unit will stabilise and protect the blister assembly. This is especially advantageous when the blister assembly is made of thin and/or flexible material. Further, separate blister parts, each carrying a different drug, can be combined to form a foldable unit by joining the blister parts to the supporting unit. In addition, the provision of a supporting unit will prevent accidental separation of a blister part from the blister assembly.

Further, since the supporting unit is joined to a tab on the protective unit, the blister pack has large continuos areas that can be printed with instructions for use or that can carry separate leaflets. Thus, the drugs always are accompanied by adequate instructions for use.

Figure 2A:
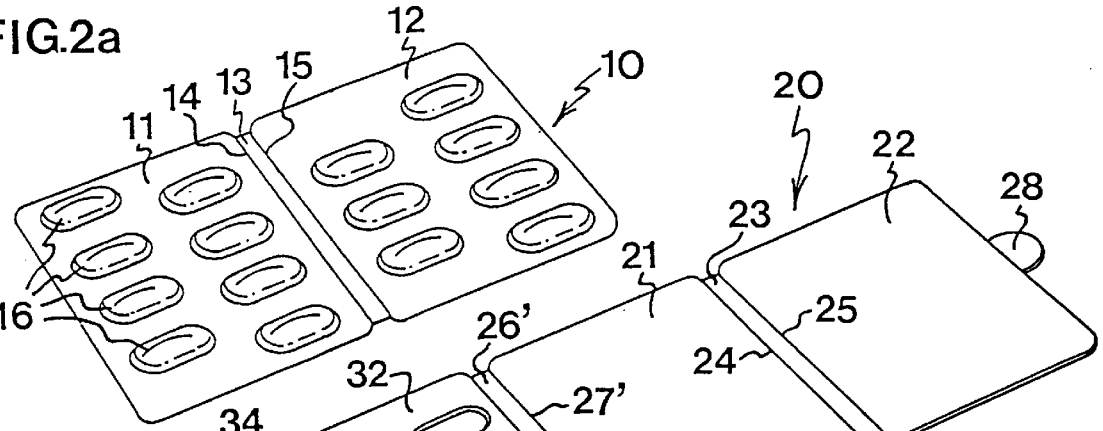
Figure 2B:
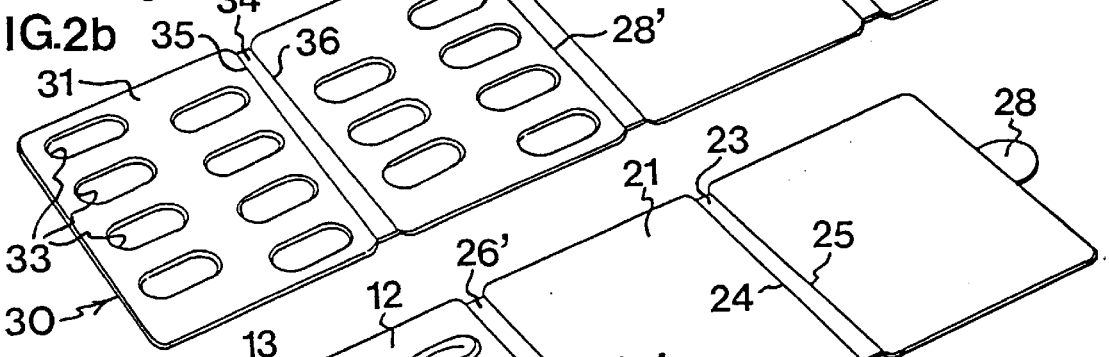
Figure 2C:
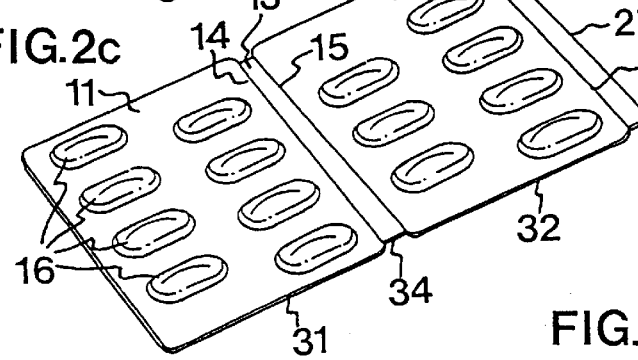
Figure 2D:
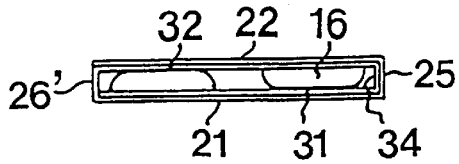
Figure 3A:
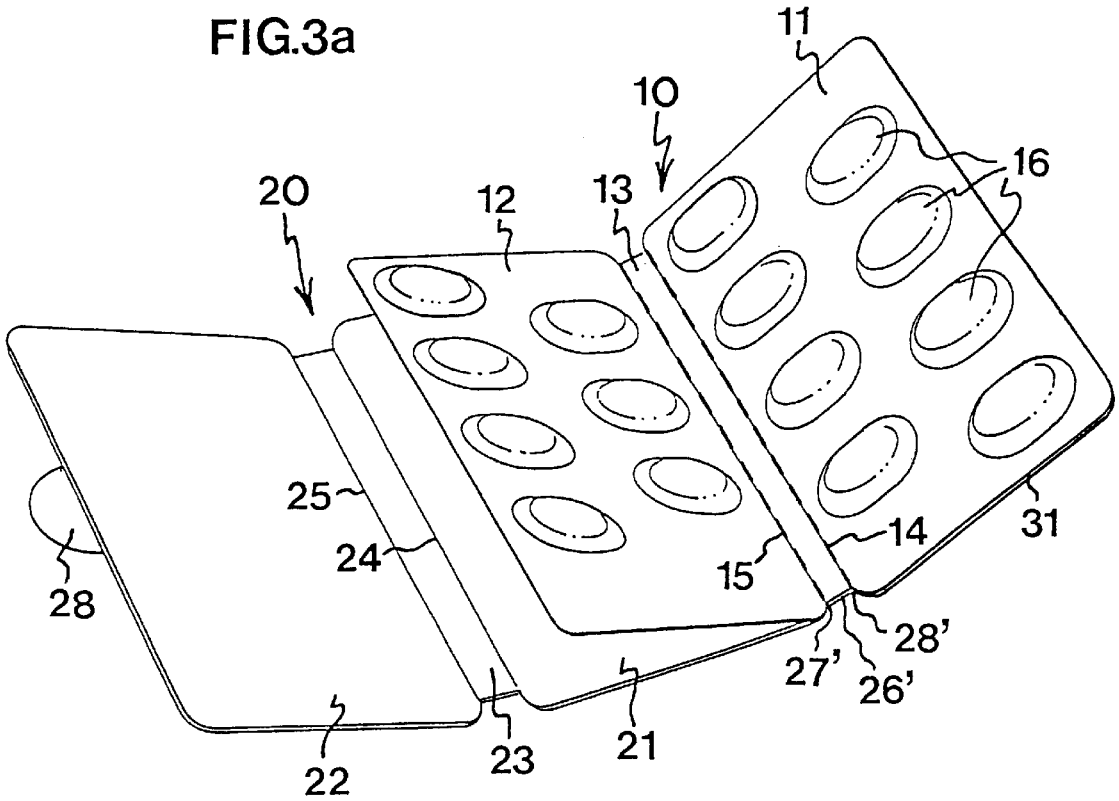
Figure 3B:
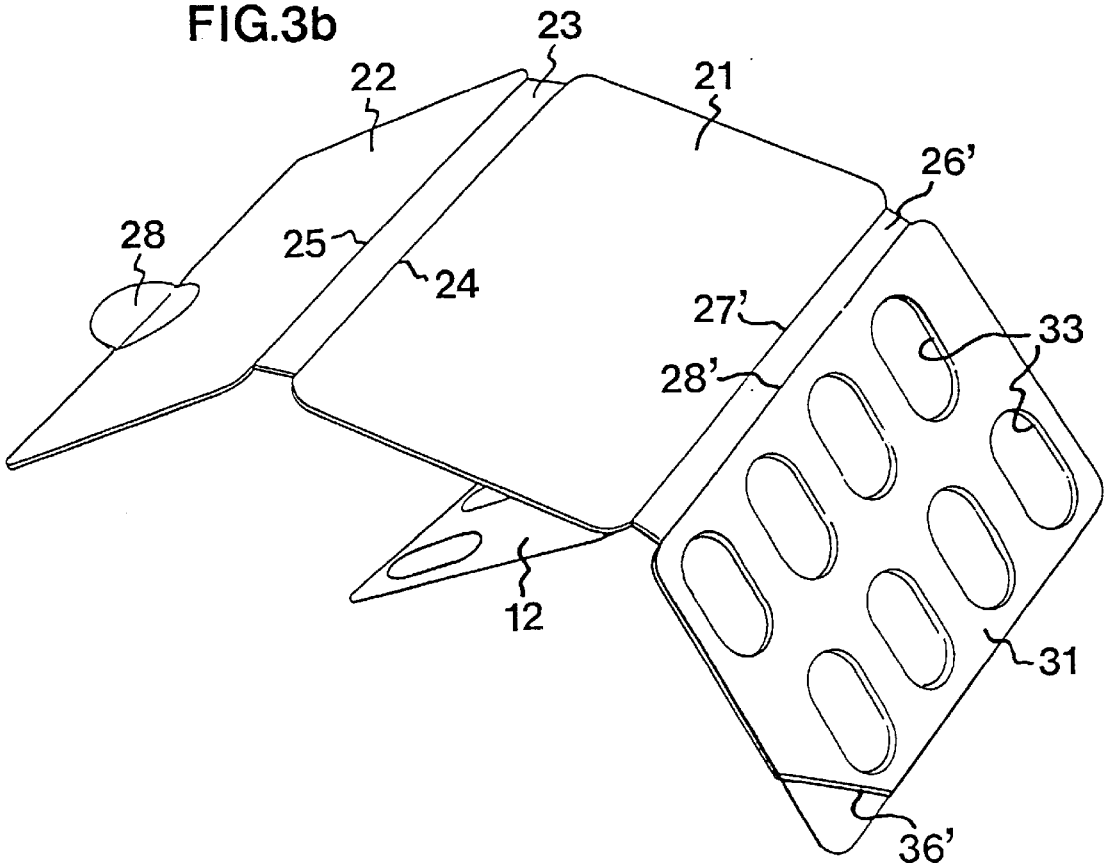

The invention will now be described in more detail with reference to the accompanying drawings, in which FIG. 1 illustrates a first preferred embodiment and shows in FIG. 1*a* the blister assembly, in FIG. 1*b* the supporting unit, in FIG. 1*c* the protective unit, in FIG. 1*d* the unfolded blister pack, and in FIG. 1*e* an end view of the folded blister pack;

FIG. 2 illustrates a second preferred embodiment and shows in FIG. 2*a* the blister assembly, in FIG. 2*b* the supporting and protective units, in FIG. 2*c* the unfolded blister pack, and in FIG. 2*d* an end view the folded blister pack; and FIG. 3 illustrates a third preferred embodiment, wherein FIG. 3*a* is a perspective view of the blister pack in unfolded condition, and FIG. 3*b* is an opposite perspective view of the blister pack in FIG. 3*a*.

The blister pack in FIGS. 1*a–e* has a blister assembly 10, which consists of a first and a second blister part 11, 12. Between the blister parts 11, 12, there is formed an intermediate part 13 defined by two parallel, longludinal folding lines 14, 15. Consequently, the blister parts 11, 12 can be folded towards each other along said folding lines 14, 15. The blister assembly 10 is composed of a base foil, in which blisters 16 are formed, and a flat lid foil, which is attached to said base foil. Thus, the lid foil seals the openings of the blisters 16, each blister 16 containing one piece of medicine, e.g. a tablet or a capsule.

Each blister part 11, 12 has two parallel rows of blisters 16, the blisters 16 of one part 11 being so offset relative to the blisters 16 of the other part 12 that, when the blister parts 11, 12 are mated in face-to-face relationship, the blisters 16 engage between each other to form a single blister layer. To this end, the height of the blisters 16 essentially corresponds to the distance between the folding lines 14, 15.

The protective unit 20 consists of first and second closure panels 21, 22 and an intermediate panel 23 therebetween. The intermediate panel 23 is defined by two parallel, longitudinal folding lines 24, 25, and the protective unit 20 is foldable along these folding lines 24, 25. Further, the protective unit 20 has a tab 26, which is connected to one longitudinal edge of the first closure panel 21 via a folding line 27.

Further, a separate supporting unit 30 is provided, which includes first and second base panels 31, 32, each having two parallel rows of holes 33. Between the base panels 31, 32, there is formed a linking panel 34 defined by two parallel, longitudinal folding lines 35, 36, along which the base panels 31, 32 can be folded towards each other.

The blister assembly 10 is attached to the supporting unit 30 in such a manner that the blisters 16 are aligned with the holes 33 and the lid foil of the blister assembly 10 is facing the supporting unit 30.

The protective and supporting units 20, 30 are so interconnected that the folding line 36 between the second base panel 32 and the linking panel 34 coincides with one edge of the first closure panel 21. To this end, the linking panel 34 of the supporting unit 30 is fixedly joined to the tab 26 on the protective unit 20. Consequently, the folding lines 24, 25, 27 of the protective unit 20 are parallel to the folding lines 14, 15 of the blister assembly 10 and folding lines 35, 36 of the supporting unit 30.

The folding of the blister pack is simple, since only two folding operations are necessary to close the pack, namely folding the first base panel 31 onto the second base panel 32 and, finally, folding the second closure panel 22 onto the first base panel 31. In the folded condition shown in FIG. 1*e*, the blister pack is protected by the closure panels 21, 22 abutting against the base panels 31, 32 and thereby covering the holes 33.

Preferably, the width of the intermediate panel 23 essentially corresponds to the thickness of the folded supporting unit 30, and the first closure panel 21 has essentially the same dimensions as the second closure panel 22, thereby creating a folded package in the form of a rectangular parallelepiped. The blister pack is maintained in its folded condition by fastening means 28, e.g. a piece of reclosable adhesive tape. Obviously, the folded blister pack is very stable and protected on all longitudinal sides.

One longitudinal side of the folded blister pack is formed by the tab 26, which is further stabilised by the supporting unit 30 and the blister assembly 10 being joined thereto. This improves the stability of the bliser pack, in particular with respect to shear forces.

It should also be noted that the supporting unit 30 will stabilise and protect the blister assembly 10. There is no risk of a blister part 11, 12 being accidentally torn away from the blister assembly 10.

In the blister pack according to the invention, instructions can be printed on the closure panels 21, 22 and/or on a separate leaflet that is fixed to one closure panel side facing the blister assembly 10. Thus, it is ensured that the drugs always are accompanied by adequate instructions for use.

In FIGS. 2*a–d*, a second preferred embodiment is shown, which differs from the first embodiment in that the supporting unit 30 is formed integral with the protective unit 20. All embodiments employ a similar blister assembly 10, which therefore need not be described in more detail here. The units 20, 30, having already been described with reference to FIGS. 1, need no further description either.

One edge of the second base panel 32 is connected to a tab 26' of the first closure panel 21 via a folding line 28'. The tab 26' is connected to the first closure panel 21 via a folding line 27'. Evidently, all folding lines 24, 25, 27', 28', 35, 36 of the protective and supporting units 20, 30 are parallel to each other.

As is apparent from FIG. 2*c*, the blister assembly 10 is joined to the supporting unit 30 in such a manner that the blisters 16 are aligned with the holes 33 and the lid foil of the blister assembly 10 is facing the supporting unit 30.

The blister pack is folded from left to right, as seen in FIG. 2*c*, the first base panel 31 being first folded onto the second base panel 32. These parallel panels 31, 32 are then folded onto the first closure panel 21 and, finally, folded onto the second closure panel 22. In the folded condition of the blister pack, the first closure panel 21 will cover the first base panel 31, and the second closure panel 22 will cover the second base panel 32, thereby protecting that part of the lid foil which is accessible through the holes 33.

The second embodiment, apart from having the same advantages, is also easier to manufacture than the first embodiment, since it contains only two separate parts. However, the second embodiment requires a more complicated folding operation and might also be more difficult to handle for the patient because of the greater length of the blister pack in unfolded condition.

FIGS. 3*a–b* show a third embodiment, which differs from the second embodiment in that the supporting unit has only one base panel 31, which is formed integral with the protective unit 20. The base panel 31 is connected to a tab 26' of the first closure panel 21 via a folding line 28'. The tab 26' is connected to the first closure panel 21 via a folding line 27'.

One and only one blister part 11 of the blister assembly 10 is joined to the base panel 31 in such a manner that the blisters 16 are aligned with the holes 33 and the lid foil faces the base panel 31.

Folding the blister pack is easy, and only two folding operations are required to close the pack, namely folding the base panel 31 onto the second blister part 12 and, finally, folding the second closure panel 22 onto the base panel 31. In folded condition, the blister pack is protected by the closure panels 21, 22 covering the holes 33 and is thereby protected on all its longitudinal sides.

The folded blister pack is very stable and shear resistant. One reason for this is that one longitudinal side of the folded blister pack is formed by the tab 26', which is stabilised by the base panel 31 being joined thereto. Since the base panel 31 is placed inside the folded pack, between the blister assembly 10 and the closure panel 22, the blister pack is locked in a stable configuration when folded. This stability is achieved with minimum use of raw material in the protective and supporting units 20, 30.

Further, since the base panel 31 is joined to the tab 26' on the protective unit 20, the blister pack has large continuos areas that can be printed with instructions for use. Thus, the drugs always are accompanied by adequate instructions for use.

This third embodiment enables the user to remove the second blister part 12, when emptied, from the blister pack by simply tearing along the folding line 15, which might be perforated to facilitate separation.

In another conceivable embodiment, the intermediate part 13 is also joined to the intermediate panel 26'. In the preferred third embodiment, the intermediate part 13 is, however, not joined to the intermediate panel 26', thereby providing the additional advantage of facilitating the removal of the drugs from the blisters, since the user has more space available for handling the blisters 16 on the second blister part 12, in particular the blisters 16 in the row adjacent to the intermediate part 13. A drug could be removed from the blister pack by the user pressing one of the blisters 16 with one of his fingers, thereby breaking the lid foil, and this preferred embodiment allows the user more liberty of action when applying pressure on the blisters. Thus, the risk of accidentally separating the blister part 12 from the blister pack is less than in a conventional blister pack.

This embodiment also has a cutout 36', which is formed at one of the comers of the base panel 31 and which uncovers part of the blister assembly 10. This feature facilitates the separation of the blister assembly 10 from the supporting and protective units 20, 30, since the blister assembly 10 can readily be gripped at the cutout 36' and be torn away from said units 20,30. In view of the recycling of the materials used, this is an attractive feature, which can be incorporated in any of the embodiments of the invention.

In all embodiments shown, the folding lines are arranged in parallel to each other. This parallelism is preferred, since it facilitates the folding of the blister pack.

Evidently, the blister assembly of the first and second embodiments of the inventive blister pack could consist of two separate blister parts, which are joined in any suitable manner, e.g. by being glued to a supporting unit.

Further, it is appreciated that the blister assembly could consist of several blister parts, which are interconnected by intermediate parts free of blisters, said blister parts being folded in pairs in a meandering manner. Also, the blister pack can include more than one blister assembly, for example by one blister part of each blister assembly being joined to a respective supporting unit on the protective unit.

Further, it should be noted that a combined blister pack could be formed from two blister packs according to the invention, preferably by joining a closure panel of one blister pack with a closure panel of the other blister pack. Referring to the embodiment of FIG. 3, the first closure panel 21 of one blister pack could, on the side facing away from the blister assembly 10, be joined to a corresponding closure panel 21 on another blister pack. This combined blister pack has the same advantages as the included, individual blister packs.

According to the invention, the blister assembly can be fixedly joined to the protective unit by any suitable means, e.g. an adhesive. This also applies to the attachment of the blister assembly to the supporting unit as well as the attachment of the supporting unit to the protective unit.

Further, the shape of the holes in the supporting unit must not necessarily correspond to the shape of the blisters and could have any form uncovering the lid foil in front of the blisters.

In a preferred embodiment, the blister pack according to the invention is used for a pharmaceutically active drug, such as a proton pump inhibitor, e.g. omeprazole. The blister pack could have at least two differently shaped sets of blisters, each set containing a different drug. This type of blister pack is especially useful for packing, in one blister pack, two drugs e.g. a proton pump inhibitor and at least one antibiotic that should be administered in combination, such as omeprazole and an antibiotic. Another embodiment of the invention is to use the blister pack for packing tablets which contain a combination of drugs.

A wide variety of antibiotics may be used in combination with a suitable proton pump inhibitor. Such antibiotics include for example nitroimidazole antibiotics, tetracyclines, penicillins, cephalosporins, carbopenems, aminoglycosides, macrolide antibiotics, lincosamide antibiotics, 4-quinolones, rifamycins and nitrofurantoin. In the following examples of such antibiotics are listed: ampicillin, amoxicillin, benzylpenicillin, phenoxymethylpenicillin, bacampicillin, pivampicillin, carbenicillin, cloxacillin, cyclacillin, dicloxacillin, methicillin, oxacillin, piperacillin, ticarcillin, flucloxacillin, cefuroxime, cefetamet, cefetrame, cefixime, cefoxitin, ceftazidime, ceftizoxime, latamoxef, cefoperazone, ceftriaxone, cefsulodin, cefotaxime, cephalexin, cefaclor, cefadroxil, cefalothin, cefazolin, cefpodoxime, ceftibuten, aztreonam, tigemonam, erythromycin, dirithromycin, roxithromycin, azithromycin, clarithromycin, clindamycin, paldimycin, lincomycin vancomycin, spectinomycin, tobramycin, paromomycin, metronidazole, tinidazole, ornidazole, amifloxacin, cinoxacin, ciprofloxacin, difloxacin, enoxacin, fleroxacin, norfloxacin, ofloxacin, temafloxacin, doxycycline, minocycline, tetracycline, chlortetracycline, oxytetracycline, methacycline, rolitetracyclin, nitrofurantoin, nalidixic acid, gentamicin, rifampicin, amikacin, netilmicin, imipenem, cilastatin, chloramphenicol, furazolidone, nifuroxazide, sulfadiazin, sulfametoxazol, bismuth subsalicylate, colloidal bismuth subcitrate, gramicidin, mecillinam, cloxiquine, chlorhexidine, dichlorobenzylalcohol, methyl-2-pentylphenol. The active antibiotics could be in standard forms or used as salts, hydrates, esters etc. A combination of two or more of the above listed drugs may be used. Preferable antibiotics are clarithromycin, erythromycin, roxithromycin, azithromycin, amoxicillin, metronidazole, tinidazole and tetracycline. Clarithromycin and metronidazole alone or in combination are especially suitable.

An apparatus (not shown) for manufacturing any of the embodiments having a supporting unit, comprises a device, such as a punching machine, for producing a protective unit and a supporting unit from one or two blanks and for providing folding lines therein, a device for applying an adhesive to the supporting unit, a device for aligning and combining a blister assembly with the supporting unit, and a device for folding the blister pack along the folding lines. In the case of a blister pack with separate supporting and protective units, the apparatus could comprise a device for combining these units before folding the blister pack.

We claim:

1. A blister pack comprising at least one blister assembly (10) including two blister parts (11, 12), each having a set of blisters (16) and being of the type in which a base foil formed with blisters (16) is connected to a substantially flat lid foil, the blister parts (11, 12) being interconnected and foldable towards each other, the blisters (16) of one blister part (11) being so offset relative to the blisters (16) of the other blister part (12) that, after folding, the blisters (16) of the two blister parts (11, 12) engage between each other, a protective unit (20) including two closure panels (21, 22) and preferably one intermediate panel (23), which is defined by two folding lines (24, 25), said protective unit (20) being foldable along said folding lines (24, 25), characterised in that a supporting unit (30) including at least one base panel (31), which has at least one hole (33), is connected to said blister assembly (10) such that the blisters (16) of at least one blister part (11) are aligned with said at least one hole (33), said protective unit (20) includes a tab (26; 26'), which is connected to one closure panel (21) via at least one folding line (27; 27'), and said supporting unit (30) is fixedly joined to said tab (26; 26') such that the closure panels (21, 22) cover said lid foils after folding of the blister assembly (10) and the protective unit (20).

2. A blister pack as claimed in claim 1, wherein said supporting unit (30) includes two base panels (31, 32), each having at least one hole (33), and a linking panel (34) therebetween, which is defined by two folding lines (35, 36), said supporting unit (30) being foldable along said folding lines (35, 36), and wherein the blister assembly (10) is connected to said supporting unit (30) such that the blisters (16) are aligned with said at least one hole (33).

3. A blister pack as claimed in claim 2, wherein said linking panel (34) is fixedly joined to said tab (26).

4. A blister pack as claimed in claim 1, wherein said supporting unit (30) includes only one base panel (31), and wherein one blister part (11) of the blister assembly (10) is joined to said base panel (31).

5. A blister pack as claimed in any one of claims 1–4, wherein said blister assembly (10) includes an intermediate part (13), which is free of blisters (16) and is located between said blister parts (11, 12) and which is defined by two folding lines (14, 15), said asssembly (10) being foldable along said folding lines (14, 15).

6. A blister pack as claimed in claim 5, wherein the folding lines (24, 25, 27; 27', 28') of the protective unit (20) are parallel to the folding lines (35, 36) of the supporting unit (30).

7. A blister pack as claimed in any one of claims 1–4, wherein the lid foil of the blister parts (11, 12) faces the supporting unit (30).

8. A blister pack as claimed in any one of claims 1–4, wherein the supporting unit (30) is integrally formed with the protective unit (20).

9. A blister pack as claimed in any one of claims 1–4, wherein the supporting unit (30) and the protective unit (20) are two separate, interconnected parts.

10. A blister pack as claimed in any one of claims 1–4, wherein the supporting unit (30) is made of paperboard.

11. A blister pack as claimed in any one of claims 1–4, wherein the protective unit (20) is made of paperboard.

12. A blister pack as claimed in any one of claims 1–4, wherein the blister assembly (10) is made of aluminum.

13. A blister pack comprising:

at least one blister assembly (10) including two blister parts (11 ,12), each having a set of blisters (16) and being of the type in which a base foil formed with blisters (16) is connected to a substantially flat lid foil, the blister parts (11, 12) being interconnected and foldable towards each other, the blister (16) of one blister part (11) being so offset relative to the blisters (16) of the other blister part (12) that, after folding, the blisters (16) of the two blister parts (11, 12) engage between each other, a protective unit (20) including two closure panels (21, 22) and preferably one intermediate panel (23), which is defined by two folding lines (24, 25), said protective unit (20) being foldable along said folding lines (24, 25), characterised in that a supporting unit (30) including at least one base panel (31), which has at least one hole (33), is connected to said blister assembly (10) such that the blisters (16) of at least one blister part (11) are aligned with said at least one hole (33), said protective unit (20) includes a tab (26; 26'), which is connected to one closure panels (21) via at least one folding line (27; 27'), and said supporting unit (30) is fixedly joined to said tab (26; 26') such that the closure panels (21, 22) cover said lid foils after folding of the blister assembly (10) and the protective unit (20);

wherein said lid foil is breakable.

14. A blister pack comprising:

at least one blister assembly (10) including two blister parts (11, 12), each having a set of blisters (16) and being of the type in which a base foil formed with blisters (16) is connected to a substantially flat lid foil, the blister parts (11, 12) being interconnected and foldable towards each other, the blisters (16) of one blister part (11) being so offset relative to the blisters (16) of the other blister part (12) that, after folding, the blisters (16) of the two blister parts (11, 12) engage between each other, a protective unit (20) including two closure panels (21, 22) and preferably one intermediate panel (23), which is defined by two folding lines (24, 25), said protective unit being foldable along said folding lines (24, 25), characterised in that there is provided a supporting unit (30) including one base panel (31), which has at least one hole (33), one blister part (11) of the blister assembly (10) is joined to said base panel (31) such that the blisters (16) of said blister part (11) are aligned with said at least one hole (33), and the protective unit (20) is fixedly joined to the supporting unit (30) such that the closure panels (21,22) cover said lid foils after folding of the blister assembly (10) and the protective unit (20);

wherein said protective unit (20) includes a tab (26; 26'), which is connected to one closure panel (21) via at least one folding line (27; 27'), said supporting unit (30) being joined to said tab (26, 26').

15. A blister pack as claimed in claim 14, wherein the lid foil of said blister part (11) faces said base panel (31).

16. A blister pack as claimed in claim 14, wherein a cutout (36') is formed at one of the corners of the base panel (31) and uncovers part of the blister assembly (10).

17. A blister pack as claimed in claim 14, wherein the supporting unit (30) is integrally formed with the protective unit (20).

18. A blister pack as claimed in claim 14, wherein the supporting unit (30) includes only one base panel (31).

19. A blister pack as claimed in claim 14, wherein said blister assembly (10) includes an intermediate part (13), which is free of blisters (16) and is located between said blister parts (11, 12) and which is defined by two folding lines (14, 15), said assembly (10) being Foldable along said folding lines (14,15).

* * * * *